US006390329B1

(12) United States Patent
Maddox

(10) Patent No.: US 6,390,329 B1
(45) Date of Patent: May 21, 2002

(54) APPARATUS FOR HANDS-FREE DISPENSING OF A MEASURED QUANTITY OF MATERIAL

(75) Inventor: Jeffrey T. Maddox, Hudson, OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 09/685,206

(22) Filed: Oct. 10, 2000

(51) Int. Cl.[7] ..... B67D 5/06

(52) U.S. Cl. ..... 222/25; 222/63; 222/207; 222/214; 222/333

(58) Field of Search ..... 222/2, 23, 25, 222/52, 63, 207, 214, 333, 113

(56) References Cited

U.S. PATENT DOCUMENTS

| | | | | | |
|---|---|---|---|---|---|
| 2,565,084 | A | * | 8/1951 | Parks | 222/25 X |
| 3,576,277 | A | | 4/1971 | Blackmon | 222/1 |
| 4,563,780 | A | | 1/1986 | Pollack | 4/192 |
| 4,606,085 | A | | 8/1986 | Davies | 4/623 |
| 4,722,372 | A | * | 2/1988 | Hoffman et al. | 222/52 X |
| 4,946,070 | A | | 8/1990 | Abert et al. | 222/52 |
| 5,086,526 | A | | 2/1992 | Van Marcke | 4/623 |
| 5,105,992 | A | * | 4/1992 | Fender et al. | 222/52 X |
| 5,217,035 | A | | 6/1993 | Van Marcke | 137/1 |
| 5,243,717 | A | | 9/1993 | Yasuo | 4/623 |
| 5,255,822 | A | * | 10/1993 | Mease et al. | 222/63 X |
| 5,449,117 | A | * | 9/1995 | Muderlak et al. | 222/646 X |
| 5,625,908 | A | | 5/1997 | Shaw | 4/623 |
| 5,823,390 | A | * | 10/1998 | Muderlak et al. | 222/333 X |
| 5,829,072 | A | | 11/1998 | Hirsch et al. | 4/605 |
| 5,855,356 | A | | 1/1999 | Fait | 251/129.04 |
| 5,868,311 | A | | 2/1999 | Cretu-Petra | 236/12.12 |
| 5,943,712 | A | | 8/1999 | Van Marcke | 4/623 |
| 5,966,753 | A | | 10/1999 | Gauthier et al. | 4/623 |
| 6,036,056 | A | * | 3/2000 | Lee et al. | 222/333 X |
| 6,206,238 | B1 | * | 3/2001 | Ophardt | 222/52 X |
| 6,209,752 | B1 | * | 3/2001 | Mitchell et al. | 222/63 |

* cited by examiner

*Primary Examiner*—Kenneth Bomberg
(74) *Attorney, Agent, or Firm*—Reese Taylor

(57) ABSTRACT

An apparatus for dispensing a measured quantity of fluid includes a touchless object sensor and a container carrying a supply of fluid. A dispense mechanism is coupled to the container to control an amount of fluid to be dispensed. A pump actuator mechanism is connected to the object sensor such that detection of an object by the object sensor cycles the pump actuator mechanism to engage the dispense mechanism which, in turn, dispenses a measured quantity of fluid. A series of lights are sequentially illuminated to instruct a user where to place the object to activate the touchless sensor and the pump actuator mechanism.

12 Claims, 7 Drawing Sheets

APPARATUS FOR HANDS-FREE DISPENSING OF A MEASURED QUANTITY OF MATERIAL

RELATED PATENT APPLICATIONS

None.

BACKGROUND OF THE INVENTION

This invention relates, in general, to devices that discharge a measured quantity of cleaning material in response to a physical input.

DESCRIPTION OF THE PRIOR ART

Dispensers, either wall-mounted or stand-alone, are used to hold a quantity of cleaning material, soap, or other disinfecting material. The dispenser is typically positioned near a source of water which is used with the cleaning material to clean the user's hands. When a user needs a quantity of cleaning material, they actuate a lever or a pump so that a quantity of material is dispensed into their hand. Typically, a predetermined amount is dispensed. This can be adjusted by shortening the pump or stroke so that a lesser amount of material is dispensed.

It will also be appreciated that if not enough material is dispensed, the user may actuate the lever additional times to get the amount needed. Additionally, if the container of material is empty, the user will actuate the lever additional times and exert excessive force in an attempt to "squeeze" out the last bits of cleaning material. This applies unnecessary stresses on the actuating lever and associated linkage and, after a period of time, can cause the dispenser to break.

There are various apparatuses that detect the presence of hands or other objects which need to be cleaned and initiate dispensing of water, but not in particular amounts. Examples of such devices are disclosed in the patents to: Yasuo, U.S. Pat. No. 5,243,717; Blackmon, U.S. Pat. No. 3,576,277; Davies, U.S. Pat. No. 4,606,085; Abert et al., U.S. Pat. No. 4,946,070; Van Marcke, U.S. Pat. No. 5,086,526; Van Marcke, U.S. Pat. No. 5,217,035; Shaw, U.S. Pat. No. 5,625,908; Hirsch et al., U.S. Pat. No. 5,829,072; and Van Marcke, U.S. Pat. No. 5,943,712. It is also known to provide devices with sensors which detect the hand position as it relates to the faucet and adjusts the temperature of the water accordingly. This is generally taught in the patents to Fait, U.S. Pat. No. 5,855,356; and the patent to Cretu-Petra, U.S. Pat. No. 5,868,311. It is also known to detect the presence of a device and initiate a timing sequence for dispensing materials when multiple users are present, as disclosed in the patent to Gauthier et al., U.S. Pat. No. 5,966,753.

Various computer-type control devices may be used in the dispensing of materials such as shown in the patent to Pollack, U.S. Pat. No. 4,563,780, which discloses a programmable device used by various members of the family to store their water temperature preferences when washing their hands.

Although the above described dispensing devices are effective in their stated purpose, it is believed that the mechanisms used to dispense a known quantity of material still exert undue forces on the dispensing mechanism which causes the devices to prematurely wear. Moreover, users who are unfamiliar with the dispensing device may grab or mis-handle the dispensing device looking for a dispensing lever when such does not need to be done. It has been found that most, if not all, automatic dispensing devices do not provide an intuitive indication of where the users are to place their hands or the object to be cleaned so that a dispensed quantity of material may be deposited thereon.

Therefore, it has become apparent that it is desirable to have an apparatus for dispensing a measured quantity of material without the need for contacting an actuating lever. It is desirable for this apparatus to be provided with some type of indicia that intuitively instructs the user where to place the object to be cleaned so that a quantity of material can be dispensed automatically.

SUMMARY OF THE INVENTION

It has been found, therefore, that an apparatus for hands-free dispensing a measured quantity of fluid material can be provided which automatically dispenses the material based upon the sensory detection of the object to be cleaned. In particular, a touchless sensor detects the presence of the object to be cleaned. Next, the apparatus energizes a motor which generates rotational motion that is received by a differential gear assembly to effectively reduce the speed of the motor and generate a consistent and limited linear motion to activate a dispensing mechanism. A container of fluid material is connected to the dispensing mechanism which deposits the measured quantity of material without the user having to actuate a push bar or lever.

Specifically, it has been found that the differential gear assembly can be provided with a spur gear that includes a hub at about its center which receives an actuator gear. A bottom portion of the hub includes at least one hub ramp within its interior. The actuator gear is slidably received in the hub and includes a sleeve ramp that coacts with the hub ramp. Accordingly, upon rotation of the spur gear, the actuator gear is projected in a linear motion to actuate the dispensing mechanism. The spur gear may be provided with holes that are sensed to control the cycle of the dispensing mechanism. To facilitate the linear motion of the actuator gear, structural features may be provided thereon that conform with a housing that carries the gear assembly. As such, the actuator gear returns to an initial position upon completion of a cycle.

It will be appreciated that the device may be provided with various features to facilitate its operation. Accordingly, a series of light emitting diodes (LEDs) may be configured to flash in a predetermined sequence. Upon observation of the LEDs, a user will intuitively place their hand in the direction of the flashing lights to trigger the touchless sensor. A different colored light emitting diode may be employed to indicate to the user that the fluid container is low and/or that the batteries which power the system are in need for replacement. Other timing features and alarms may be provided so that the user knows for how long to wash their hands and to also provide a count mechanism for management personnel to ensure that hand-washing is taking place when required. A hidden switch may also be provided to disable the unit whenever service personnel are cleaning underneath the dispenser to preclude inadvertent dispensing of the fluid material.

Accordingly, use and operation of an apparatus for hands-free dispensing of a measured quantity of material, as described above, becomes the principle object of this invention with other objects thereof becoming more apparent upon a reading of the following brief specification considered and interpreted in view of the accompanying drawings.

DESCRIPTION OF THE PREFERRED EMBODIMENTS

Figure 1:
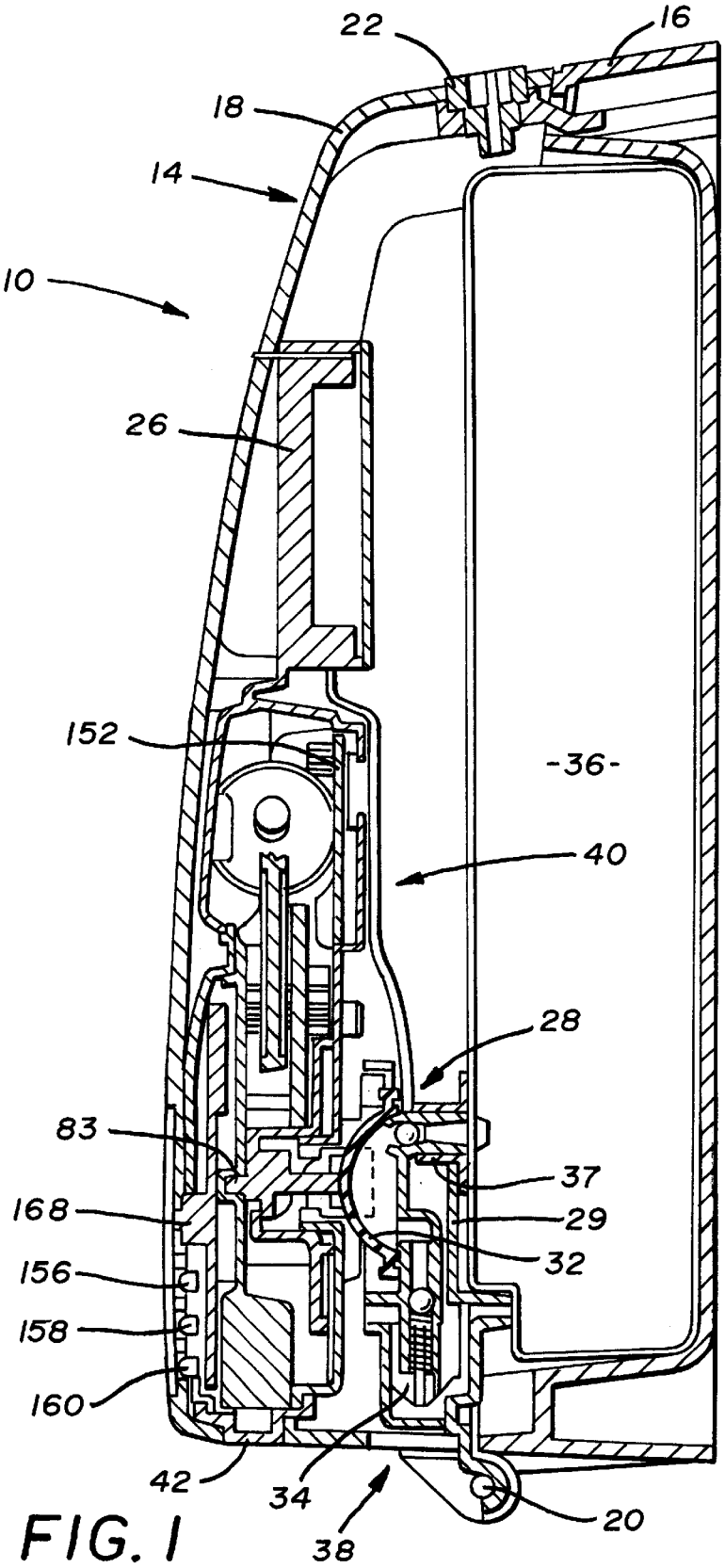
FIG. 1 is a side elevational cross-sectional diagram of the apparatus.
Figure 2:
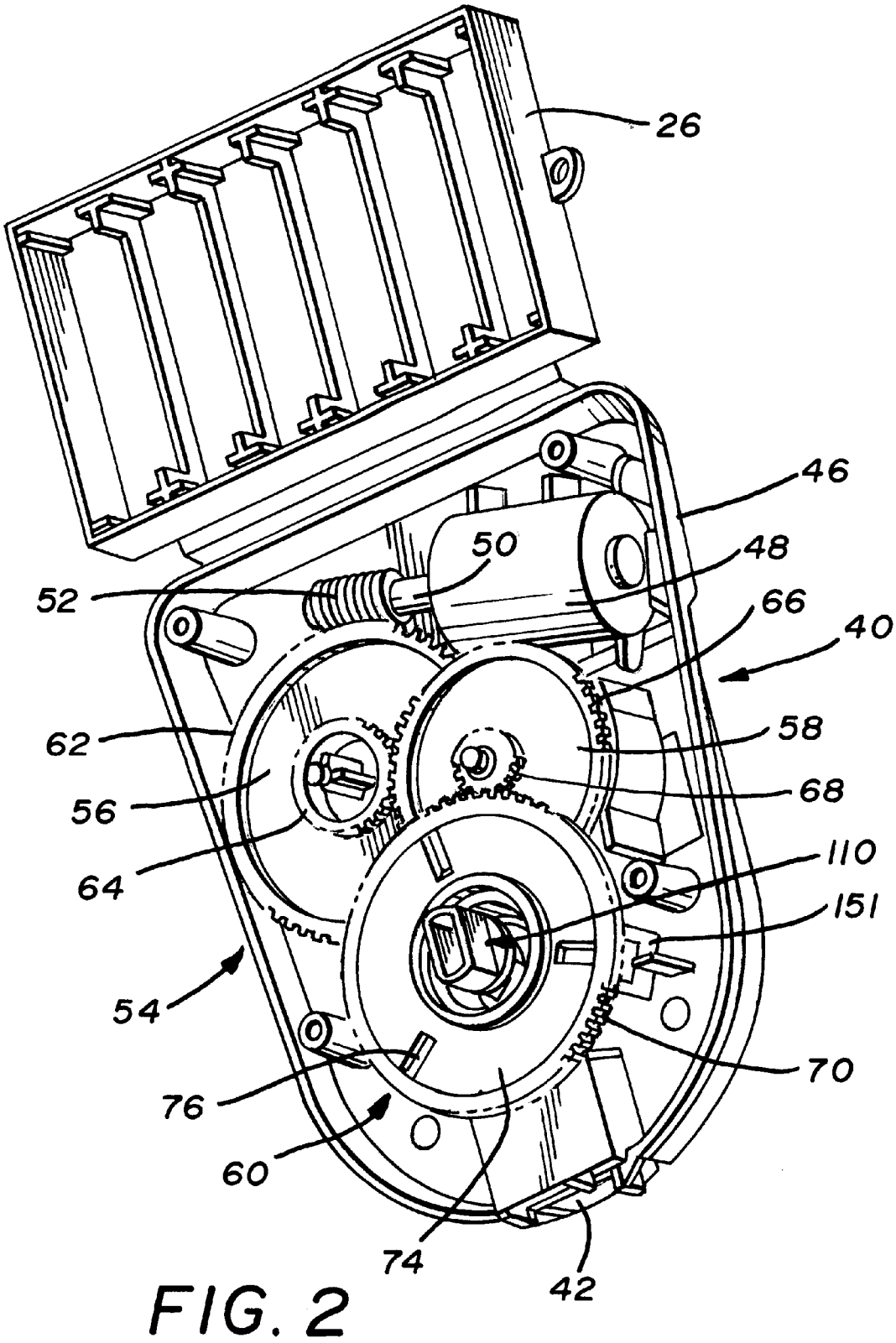
FIG. 2 is a front perspective view of a pump actuator mechanism employed in the apparatus.
Figure 3:
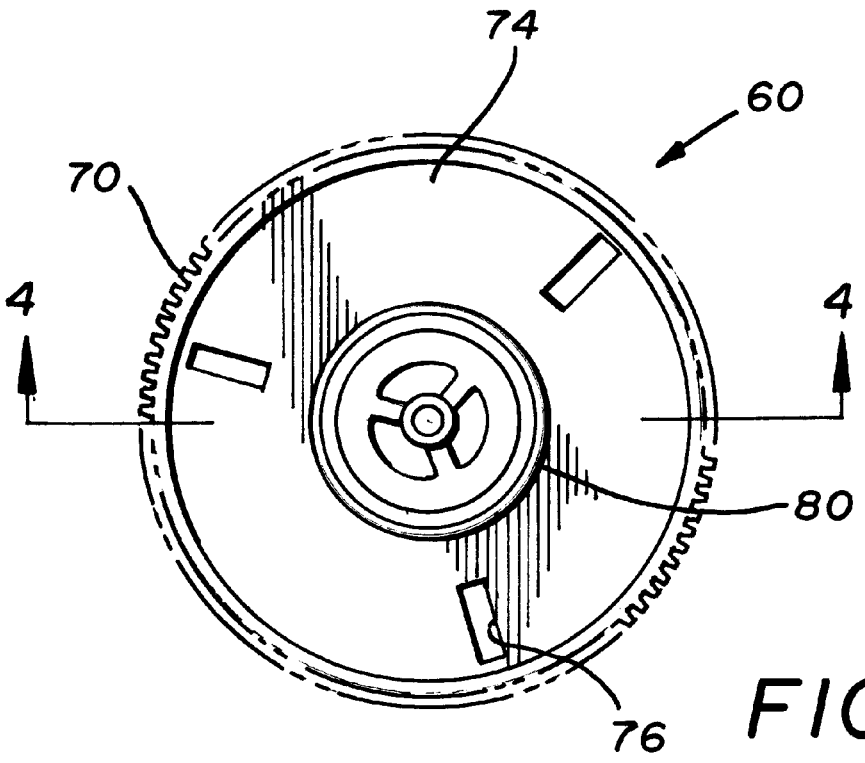
FIG. 3 is a top plan view of a spur gear employed in the pump actuator mechanism.
Figure 4:
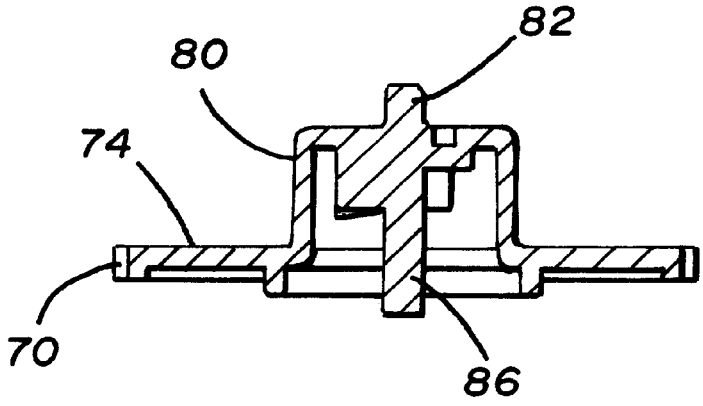
FIG. 4 is a cross-sectional view, taken substantially along line 4—4 of FIG. 3, of the spur gear.
Figure 5:
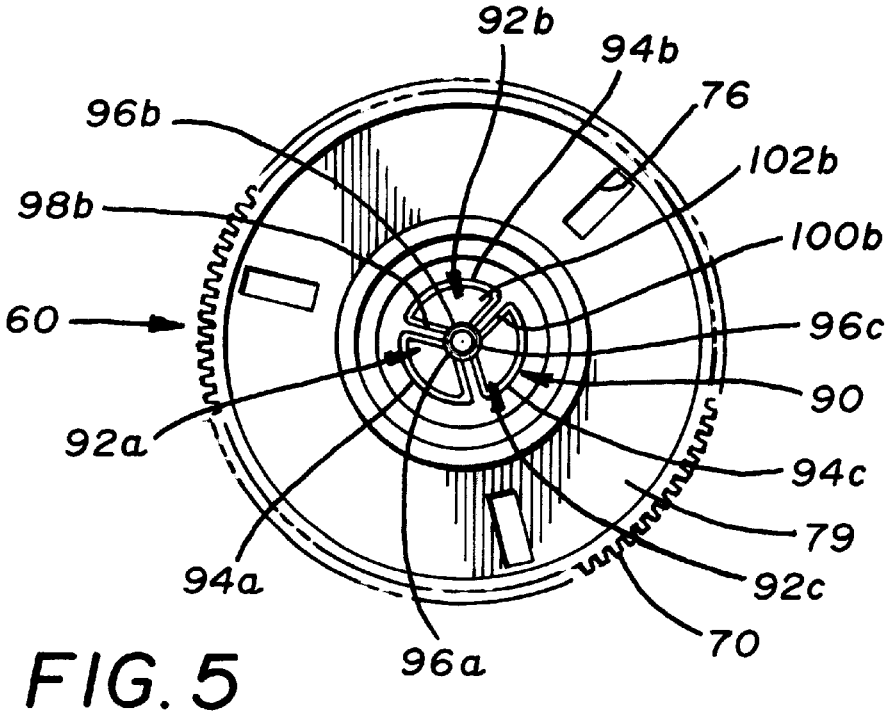
FIG. 5 is a bottom plan view of the spur gear employed in the pump actuator mechanism.
Figure 6:
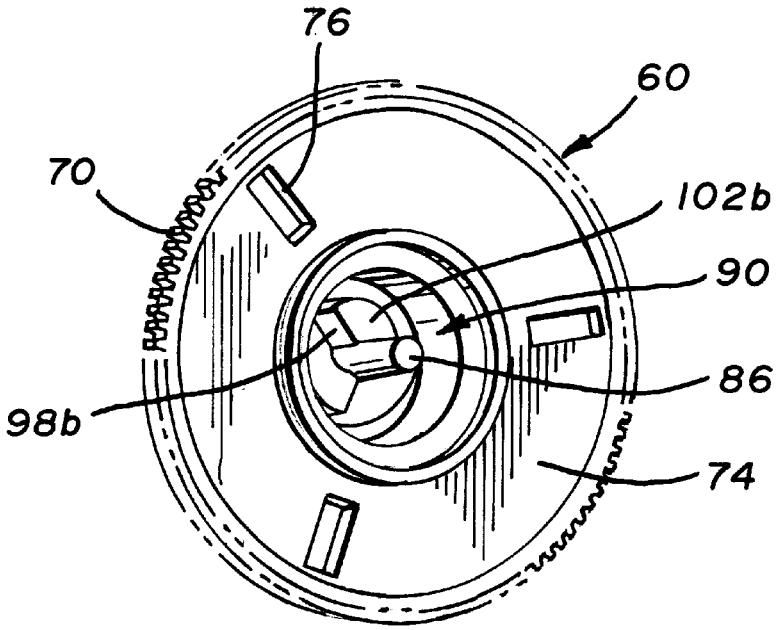
FIG. 6 is a rear perspective view of the spur gear.

FIG. 1 depicts an apparatus or dispenser, generally designated by the numeral 10, for dispensing a measured quantity of material as a result of hands-free actuation. The dispenser 10, which may be a wall-mounted or a stand-alone device, includes a housing 14 having a back shell 16 mateable with a front shell 18. In the preferred embodiment, the back shell 16 and the front shell 18 are connected by a hinge 20 at an underside of the dispenser 10. If desired, the hinge mechanism may be placed on either side of the dispenser 10 or at its top. A key latch 22 is provided at the side opposite of the hinge 20 so as to hold the front shell 18 in a mated position with the back shell 16. This encloses the device and precludes its access by unauthorized personnel. Although a key latch is shown, it will be appreciated that other mechanisms for latching the two shells 16 and 18 to one another may be employed. The shells 16 and 18 are preferably manufactured of a rigid plastic material which maintains its appearance, is easy to manufacture, and easily withstands day-to-day use.

A battery compartment, designated generally by the numeral 26, is carried by an interior surface of the housing 14. The battery compartment 26, in the preferred embodiment, carries six AA batteries. The batteries are employed to operate various features of the dispenser as will become apparent from the discussion below. Of course, other battery sizes could be employed. Alternatively, an AC power source or the like could be used.

A dispense mechanism, which is generally designated by the numeral 28, is carried by a plate 29. The hinge 20 carries the plate 29 such that when the front shell 18 is opened, the dispense mechanism 28 remains supported by the plate 29. The dispense mechanism 28 may be one commonly available in the art or, in the preferred embodiment, is like the one disclosed in U.S. patent application Ser. No. 09/397,314 filed on Sep. 16, 1999, and which is assigned to the Assignee of the present invention and which is incorporated herein by reference. The dispense mechanism 28 incorporates a pump dome valve 32 which, when pressed, dispenses a measured quantity of fluid material carried by a fluid material container 36. The dispense mechanism 28 is coupled to the container 36 via a connector 37. The container 36 is a replaceable unit as is well known in the art. When the pump dome valve 32 is actuated, the material is dispensed via a nozzle 34 through an opening 38 in a bottom portion of the front shell 18 into the user's hand, as will be described in detail below. The fluid material container 36 may contain soap, disinfectant, or other fluid material that is dispensable through the pump mechanism 28. Ideally, the container 36 will carry 1,000 mL of fluid material product. The dispense mechanism 28 typically deposits or dispenses 1.5 mL of product per cycle. Of course, the container 36 may be different sizes. And the dispense mechanism may dispense different quantities.

A pump actuator mechanism, which is generally shown in FIG. 1 and which is shown in detail in FIGS. 2–10, and generally designated by the numeral 40, includes an infrared sensor 42. The infrared sensor is positioned at an area near the opening 38 of where the dispense mechanism 30 deposits the material. The infrared sensor detects the presence of an object, such as a user's hand or other object to be cleaned, and cycles the pump actuator mechanism 40 to dispense a measured quantity of fluid material. The infrared sensor 42 includes an emitter and receiver to detect the presence of a user's hand or other object. The receiver will receive light at 940 nm modulated at 38 kHz with a 50% duty cycle. The emitter will transmit a 940 nm+/−50 mm signal. Various sensitivity settings may be used for the sensor. In the preferred embodiment, the sensor will dispense with 100% certainty when an object is within 4 inches. It will dispense with greater than 50% certainty for an object detected 4.1 to 4.5 inches from the sensor axis. An object further than 4.6 inches from the sensor will not be detected. Of course, other commercially available sensors which detect the presence of an object, without direct physical contact, and generate a corresponding actuation signal may be employed in the present invention.

The pump actuator mechanism 40 is carried in an assembly housing 46 which is replaceably mounted to the interior of the front shell 18 such that when the front shell is hingedly opened, the assembly housing 46 moves in a like manner. Carried in the assembly housing 46 is a motor 48 which is powered by the batteries carried in the battery compartment 26. The motor has a rotatable shaft 50 extending therefrom with a worm gear 52 at one end. The worm gear 52 operatively drives a differential gear assembly 54 in a manner well known in the art. Briefly, the purpose of the differential gear assembly is to significantly reduce the speed of the motor output so that the dispensing of the material can be easily controlled. Alternatives for imparting a force to the differential gear assembly could be provided by a piston or solenoid configuration.

The differential gear assembly 54 converts the initial high-speed rotation of the motor shaft to a more manageable rotational speed that can then be converted into a linear motion that repeatably engages the dispense mechanism 30. The differential gear assembly 54 includes three spur gears 56, 58, and 60. The worm gear 52 contacts a plurality of outer teeth 62 of the first spur gear 56. The spur gear 56 also includes a plurality of inner teeth 64 that mesh with a plurality of outer teeth 66 extending from the periphery of the second spur gear 58. In a like manner, a plurality of inner teeth 68 of the spur gear 58 engage a plurality of outer teeth 70 of the spur gear 60. As those skilled in the art will appreciate the rotational velocity of the spur gear 60 is significantly reduced by the interconnecting gears 56 and 58.

As best seen in FIGS. 1 and 3–6, the spur gear 60 includes a plate 74 with radially disposed slots 76 extending therethrough and positioned in about 120° increments. It will be appreciated that the number of slots and their position can be varied as needed. Extending from the plate 74 in one direction is a hub 80 from which further extends a nub 82. The nub 82 is received in an indentation 83 in one side of the assembly housing 46 so as to rotatably receive and align the gear 60. This assists in the uniform and efficient rotation of the gear 60 which, in turn, ensures the effective operation of the mechanism 40.

An axial stem 86 may concentrically extend from a bottom surface of the hub 80 toward the plate 74. Disposed between an interior wall of the hub 80 and the axial stem 86 is a hub cam, generally designated by the numeral 90. The hub cam 90 is concentrically disposed around the stem 86.

The hub cam 90 includes a plurality of hub ramps 92, wherein each hub ramp is provided with an alphabetic suffix designation (a, b, or c in the drawings). Although three hub ramps 92 are shown, it will be appreciated by those skilled in the art that one, two, or more ramps may be provided, depending upon the desired pumping action. The hub ramps 92 are essentially identical in construction and their various features are also provided with a corresponding alphabetic designation. Each hub ramp 92 includes an outer wall 94 which is concentrically adjacent the interior wall of the hub 80, and an inner wall 96 which is concentrically adjacent the axial stem 86. The outer walls may be integral with the interior hub wall, or they may be spaced apart from the wall, as shown. Likewise, the inner walls may be spaced apart from the axial stem, or they may be integral, as shown. The outer wall 94 and the inner wall 96 are connected at one end by a trailing wall 98 and at the opposite end by a leading wall 100. Each of these walls—94, 96, 98, and 100—are connected by a cam surface 102 which angularly extends from the trailing wall 98 to the leading wall 100. The leading wall 100 is of minimal height at the bottom of the hub. The cam surface 102 rises up from the leading wall 100 and extends to the trailing wall 98. The top of the trailing is at about a mid-point position between the bottom of the hub 80 and the plate 74.

Figure 7:
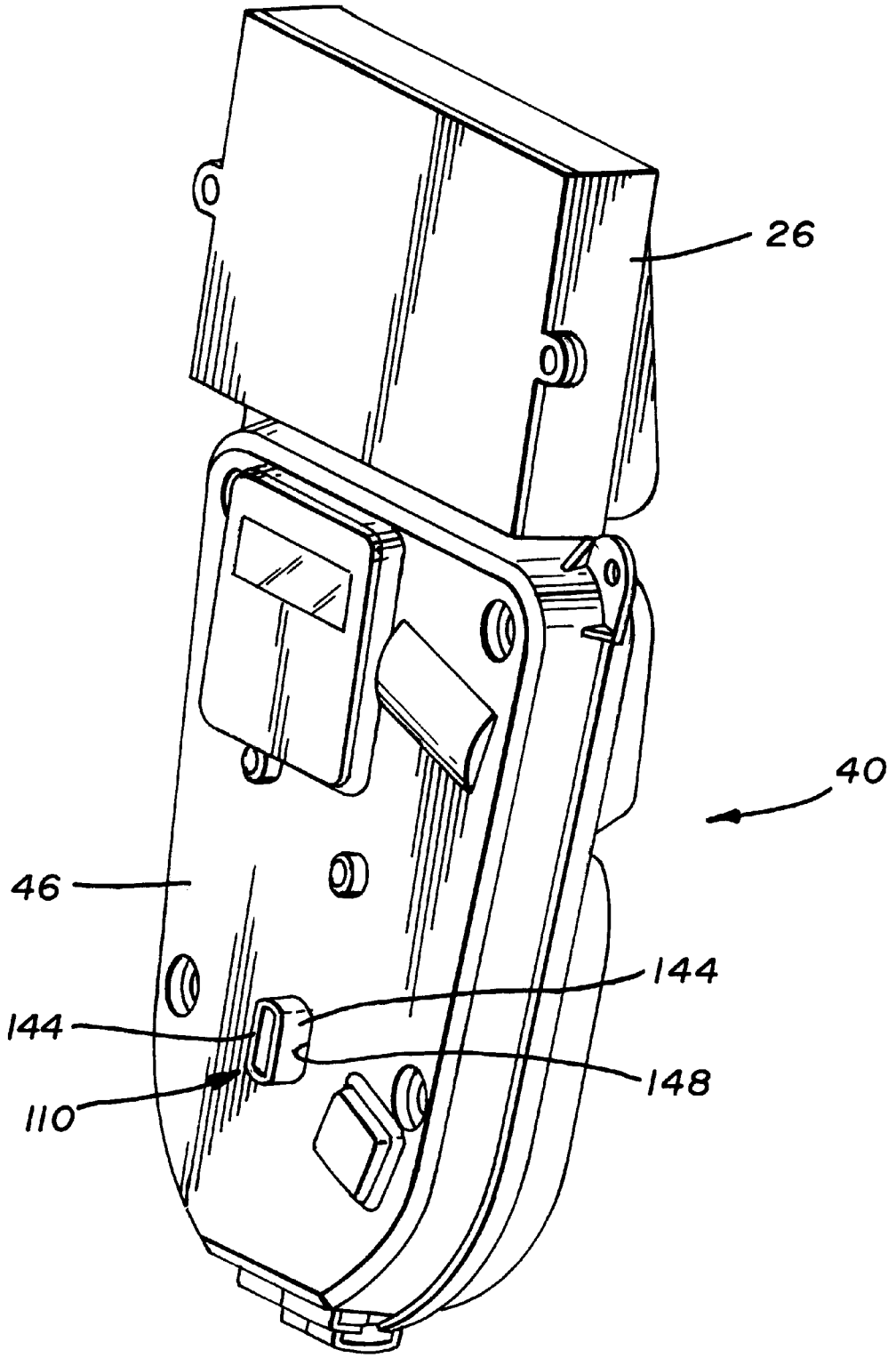
FIG. 7 is a rear perspective view of the pump actuator mechanism.

In order to convert the rotational motion of the motor shaft 50, an actuator gear, generally designated by the numeral 110, is slidably received within the hub 80. The actuator gear 110 is also slidably captured within the housing 46, as seen in FIG. 7. Accordingly, the actuator gear 110 is moveable into and out from the assembly housing to actuate the dispense mechanism 30.

Figure 8:
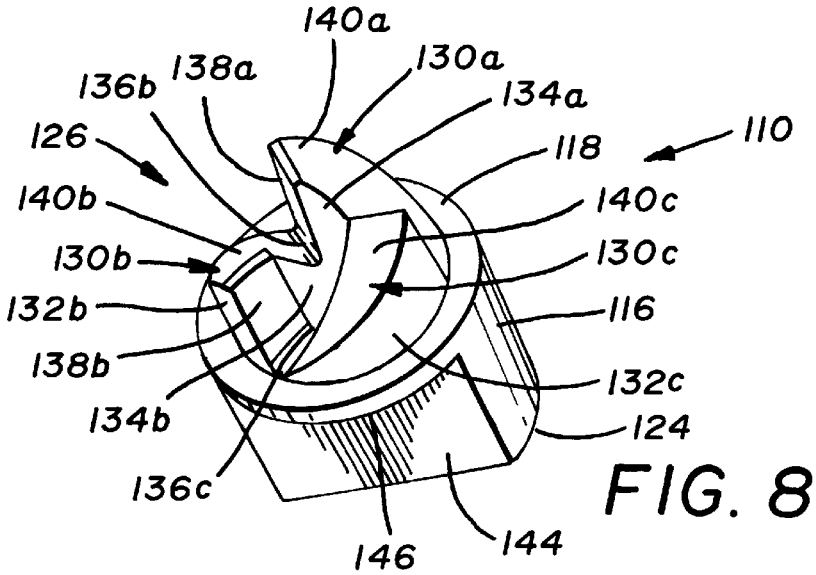
FIG. 8 is a front perspective view of an actuator gear employed in the pump actuator mechanism.
Figure 9:
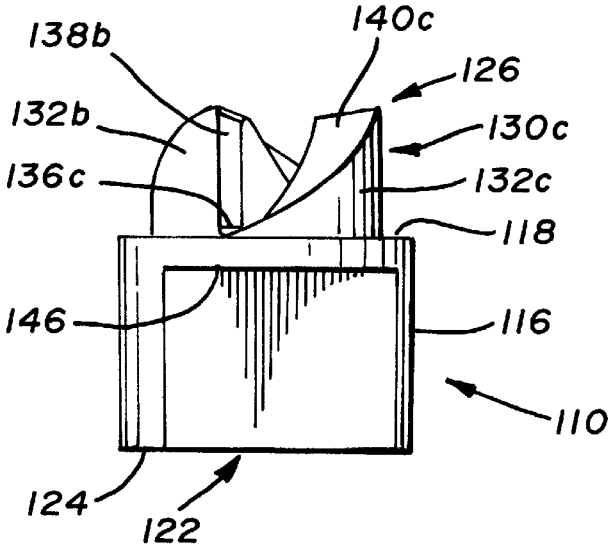
FIG. 9 is a side elevational view of the actuator gear.
Figure 10:
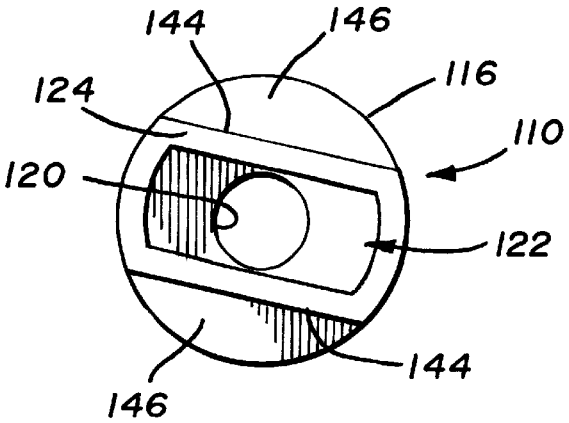
FIG. 10 is a bottom elevational view of the actuator gear.

The actuator gear 110, as best seen in FIGS. 8–10, includes a sleeve 116 which has a partially enclosed end 118 with a hole 120 therethrough. The hole 120 slidably fits over the axial stem 86 for alignment and positioning purposes. Opposite the partially closed end, the sleeve has a rim 124 that forms an open end 122. Extending outwardly from the partially closed end 118 is a sleeve cam 126 which coacts with the hub cam 90. The sleeve cam 126 includes a plurality of sleeve ramps 130 which have alphabetic suffix designations for each of the ramps provided. The number of ramps provided correspond to the number of ramps provided by the hub cam 90. Each sleeve ramp 130 includes an outer wall 132 and an inner wall 134. The outer and inner wall are joined by a leading wall 136 and a trailing wall 138. Each ramp 130 provides a cam surface 140 that interconnects the outer, inner, leading, and trailing walls.

Initially, the actuator gear 110 is primarily received within the hub 80. Accordingly, the trailing walls 98 align with the leading walls 136 in a resting position. When the sensor 42 detects an object and initiates the pump actuator mechanism 40, the gear 60 rotates and the camming action upon the actuator gear 110 is initiated. As this happens, the rim 124 moves axially outwardly from the plate 74 and compresses the dome valve 32. This continues until the trailing walls 98 are aligned with the trailing walls 138. At which time, due to the resiliency of the pump dome valve 32, the actuator gear 110 falls back into the hub and the rim 124 returns to its original position. Alternatively, instead of relying on the resiliency of the dome, the actuator gear could be returned to its initial position by use of additional gearing or by spring biasing. In any event, reciprocating motion of the actuator gear 110 cycles the dispense mechanism 30.

In order to maintain alignment and to hold the actuator gear 110 within the housing, the sleeve 116 includes a pair of opposed flats 144. Each flat 144 extends from the rim 122 to a stop plate 146. The housing 46 has a rounded-slot 148 that slidably receives a portion of the actuator gear 110. In particular, the flats 144 extend through the slot 148, while the interior of the housing 46 bears against the stop plates 146 when the gear 110 is fully extended. This precludes the actuator gear 110 from falling out of the housing and ensures that the actuator gear 110 remains in place and is returnable to a starting position to initiate additional operating cycles.

A sensor 151 is provided in the assembly housing 46 and is alignable with the slots 76 and the plate 74. Accordingly, as the sensor 151 detects the passing of the slot 76, the sensor instructs the motor to stop rotation. This ensures that only one actuating of the dispensing mechanism occurs for each detection of a hand or object to be cleaned underneath the sensor 42. Of course, the sensor 151 could be situated or programmed to allow for passage of two or more slots 76 to allow for multiple cycling of the dispense mechanism 30. The sensor 151 could be an infrared type that detects interruption of an infrared beam. A magnetic proximity switch or a monitored timer could also be used to detect gear position.

Figure 11:
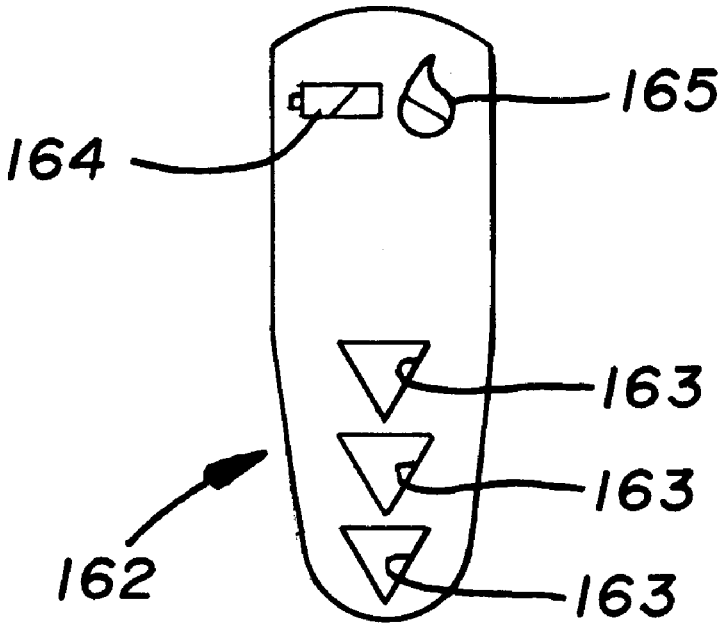
FIG. 11 is an elevational view of a front panel of the apparatus.
Figure 11A:
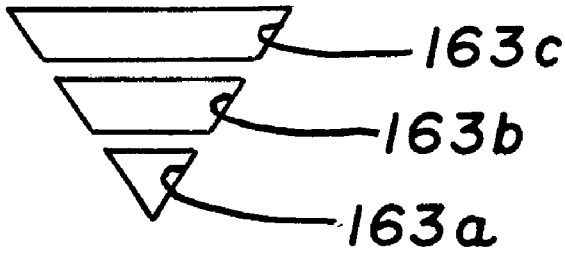
FIG. 11A is an elevational view alternative indicia configuration of the front panel.

The pump actuator mechanism 40 includes a control circuit 152 which utilizes the power generated from the batteries to illuminate a series of light emitting diodes 156, 158, and 160 that are viewable through a panel 162 on the front shell 16. The panel, as seen in FIG. 11, is provided with indicia adjacent the LEDs to assist the user. In the preferred embodiment, the panel provides downwardly pointing triangles 163. These LEDs are preferably green in color and may be sequenced to illuminate in a manner which indicates the direction in which the user must place their hand to activate the sensor 42. For example, the top LED 156 is illuminated first and then followed in rapid succession by LEDs 158 and 160. After a predetermined delay, the lighting sequence starts over. Moreover, other shapes or combinations of dissimilar shapes could be used in place of the triangles 163. See, for example, FIG. 11A. Although three LEDs are shown, it will be appreciated that two or more LEDs may be provided. Also provided in a viewable area of the front shell is a low battery indicia LED 164 which, when illuminated, indicates that the batteries are running low. A low fluid indicia LED 165 is illuminated when a sensor (not shown) detects that the container 36 needs to be replaced. The LEDs 164 and 165 may be any color, but preferably they are red and yellow, respectively.

Also provided in an area near the LEDs is a smart switch 168. Location of this switch is typically only known by housekeeping personnel and is depressed so as to disable the sensor 42 for a predetermined time period, e.g., one minute. This allows the housekeeping personnel to clean underneath the dispenser without activating the dispensing mechanism during that time. Openings of the front shell 18 also removes the coupling between the pump actuator mechanism 40 and the dispense mechanism 28. In this position, actuation of the sensor 42 will not cause inadvertent dispensing of material.

Other features which may be added to the dispenser are timing mechanisms which emit an audible tone when the dispenser is cycled. A 20-second timer then emits another tone to indicate that a washing event may be completed. Also, the dispenser may be provided with an AC adapter so as to eliminate the need for battery power. Yet another feature of the present invention is that a malfunctioning pump actuator mechanism or dispense mechanism may be easily replaced by opening the front shell and removing the appropriate fasteners and then installing a new unit.

It is apparent that from the above description of the structure and operation of the dispenser 10 that the problems and shortcomings associated with previous dispensing mechanisms have been overcome. In particular, the dispenser 10 provides a device for detecting the presence of an object and then dispensing a measured quantity of cleaning material for that object. This feature is advantageous in that a mechanical lever or push-bar is not required and, as such, problems associated therewith are eliminated. Moreover, actuation of the dispense mechanism is with a consistent and limited force that is linear and, as such, wear and tear on the associated dispensing mechanism is significantly reduced as opposed to known automated dispensers. Yet another advantageous feature of the present invention is the use of a series of light emitting diodes which intuitively instruct the user to place their hand underneath the device for actuation. It will be appreciated that this concept is adaptable to other touchless dispensing devices to facilitate their use in a number of environments.

While a fall and complete description of the invention has been set forth in accordance with the dictates of the Patent Statutes, it should be understood that modifications can be resorted to without departing from the spirit hereof or the scope of the appended claims.

For example, the invention has been described in the context of a dispensing mechanism for cleaning hands. However, it is apparent that the structure and operational methods of the apparatus could easily be adapted for dispensing any type of fluid material that is initiated or cycled by actuation of a touchless sensor.

What is claimed is:

1. Apparatus for dispensing a measured quantity of fluid, comprising:

a) an object sensor;

b) a container carrying a supply of fluid;

c) a dispense mechanism coupled to said container to control an amount of fluid to be dispensed; and d) a pump actuator mechanism coupled to said object sensor, wherein detection of an object by said object sensor cycles said pump actuator mechanism to engage said dispense mechanism which dispenses a measured quantity of fluid and wherein said pump actuator mechanism converts rotational motion to linear motion to cycle said dispense mechanism, wherein said pump actuator mechanism comprises a motor having a rotatable shaft, a differential gear assembly driven by said rotatable shaft, and an actuator gear driven by said differential gear assembly to cycle said pump actuator mechanism, and wherein said differential gear assembly includes at least one gear having a hub which slidably receives said actuator gear.

2. The apparatus according to claim 1, wherein said hub has at least one hub ramp and wherein said actuator gear has at least one sleeve ramp that coacts with said hub ramp, such that rotation of said at least one gear linearly moves said actuator gear.

3. The apparatus according to claim 2, further comprising:

a gear sensor associated with said at least one gear, wherein said gear sensor detects rotation of said at least one gear and stops rotation thereof a predetermined time after detection of the object by said object sensor.

4. The apparatus according to claim 1, further comprising:

a hidden switch carried by the apparatus, wherein actuation of said hidden switch disables said object sensor for a predetermined period of time.

5. The apparatus according to claim 1, further comprising:

a series of lights carred by the apparatus, wherein said series of lights are sequentially illuminated to indicate where the object should be placed for detection by said object sensor.

6. Apparatus for automatically dispensing a fluid comprising:

a) a container carrying a supply of fluid;

b) a pump dome valve connected to said container, wherein actuation of said pump dome valve dispenses the fluid;

c) a pump actuator mechanism having a motor that turns a rotatable shaft, wherein said pump actuator mechanism comprises a differential gear assembly driven by said rotatable shaft, an actuator gear coupled to said differential gear assembly, and an assembly housing to carry said motor, said differential gear assembly and said actuator gear, wherein said assembly housing has a slot that slidably retains said actuator gear, and wherein rotation of said shaft engages said differential gear assembly which in turn linearly moves said actuator gear in said slot and contacts said pump dome valve; and d) a touchless sensor positioned near said pump dome valve, wherein said touchless sensor monitors an area below where said pump dome valve dispenses when open and upon detection of an object in said area, energizes said motorized pump actuator which rotates said shaft which, in turn, opens said pump dome valve for a predetermined period of time.

7. The apparatus according to claim 6, wherein said differential gear assembly and said actuator gear further comprise at least one gear having a hub that receives said actuator gear, said hub having a plurality of internally disposed hub ramps, said actuator gear having a like plurality of sleeve ramps that are engageable by said hub ramps, wherein rotation of said at least one gear causes said hub ramps to impart a force to said sleeve ramps to linearly move said actuator gear.

8. The apparatus according to claim 7, wherein said hub ramps disengage from said sleeve ramps after said at least one gear rotates a predetermined amount.

9. Apparatus for dispensing a fluid material comprising:

a) a container carrying a supply of fluid;

b) a valve coupled to said container;

c) a pump mechanism operatively opening said valve for a predetermined period of time; and d) an illumination device that prompts a user where to position the object to receive a quantity of said fluid, wherein said illumination device comprises at least two lights, wherein said lights are sequentially illuminated to indicate where an object should be placed for receipt of the fluid.

10. The apparatus according to claim 9, wherein a top light is illuminated first followed in succession by the remaining lights, and after a predetermined delay said top light is illuminated again to repeat the sequence continually to provide a directional prompt to the user without the use of any other indicia.

11. The apparatus according to claim 9, further comprising:

a touchless sensor operatively controlling said pump mechanism, wherein said touchless sensor detects the presence of the object and cycles said pump mechanism.

12. Apparatus for dispensing a measured quantity of fluid, comprising:

a) an object sensor;

b) a container carrying a supply of fluid;

c) a dispense mechanism coupled to said container to control an amount of fluid to be dispensed;

d) a pump actuator mechanism coupled to said object sensor, wherein detection of an object by said object sensor cycles said pump actuator mechanism to engage said dispense mechanism which dispenses a measured quantity of fluid and wherein said pump actuator mechanism converts rotational motion to linear motion to cycle said dispense mechanism; and e) a hidden switch carried by said container, wherein actuation of said hidden switch disables said object sensor for a predetermined period of time.

* * * * *

UNITED STATES PATENT AND TRADEMARK OFFICE

CERTIFICATE OF CORRECTION

PATENT NO. : 6,390,329 B1
APPLICATION NO. : 09/685206
DATED : May 21, 2002
INVENTOR(S) : Jeffrey T. Maddox It is certified that error appears in the above-identified patent and that said Letters Patent is hereby corrected as shown below:

In Column 10, line 10 (Claim 12, line 14) please delete the words "said container" and insert --the apparatus-- in place thereof.

Signed and Sealed this

Twenty-eighth Day of October, 2008

JON W. DUDAS
*Director of the United States Patent and Trademark Office*